US009143853B2

(12) United States Patent
Sorensen

(10) Patent No.: US 9,143,853 B2
(45) Date of Patent: Sep. 22, 2015

(54) HEADSET WITH TURNABLE EAR HOOK WITH TWO OFF POSITIONS

(75) Inventor: Michael Sorensen, Jyllinge (DK)

(73) Assignee: GN Netcom A/S (DK)

( * ) Notice: Subject to any disclaimer, the term of this patent is extended or adjusted under 35 U.S.C. 154(b) by 730 days.

(21) Appl. No.: 13/502,172

(22) PCT Filed: Oct. 16, 2009

(86) PCT No.: PCT/DK2009/000221

§ 371 (c)(1),
(2), (4) Date: Jun. 7, 2012

(87) PCT Pub. No.: WO2011/044897

PCT Pub. Date: Apr. 21, 2011

(65) Prior Publication Data

US 2012/0243704 A1 Sep. 27, 2012

(51) Int. Cl.
*H04R 25/00* (2006.01)
*H04R 1/10* (2006.01)

(52) U.S. Cl.
CPC ..... *H04R 1/1041* (2013.01); *H04R 1/105* (2013.01); *H04R 2201/109* (2013.01)

(58) Field of Classification Search
CPC ..... H04M 1/05; H04M 1/6058; H04R 1/1041
USPC ..... 381/381
See application file for complete search history.

(56) References Cited

U.S. PATENT DOCUMENTS

| | | | | |
|---|---|---|---|---|
| 7,539,525 | B2 * | 5/2009 | Kim | 455/575.2 |
| 2005/0058280 | A1 | 3/2005 | Ma | |
| 2007/0133836 | A1 * | 6/2007 | Lee | 381/370 |
| 2008/0051166 | A1 * | 2/2008 | Kang et al. | 455/575.7 |

FOREIGN PATENT DOCUMENTS

| | | | |
|---|---|---|---|
| CN | 1849800 | | 10/2006 |
| JP | 2008294872 | A * | 12/2008 |
| WO | WO 03/107716 | | 12/2003 |
| WO | WO 2006/129290 | | 12/2006 |

OTHER PUBLICATIONS

English translation for Office Action for Chinese application CN1849800A.

* cited by examiner

*Primary Examiner* — Sonia Gay
(74) *Attorney, Agent, or Firm* — Altera Law Group, LLC

(57) ABSTRACT

A headset (1) comprising a switch (15; 19) and an actuating member (13), which is turnable in relation to the housing (2) about a first axis (A1). An ear hook (3; 32) is attached to the actuating member (13). The ear hook (3; 32) can be arranged in a right ear mode for wearing the headset (1) at the right ear and a left ear mode for wearing the headset at the left ear. The switch (15; 19) switches the headset electronics from an active state to a passive state, when the ear hook (3) is turned about the first axis (A1) in a first direction (P1) from an active position to a first passive position. The switch (15; 19) switches the headset electronics from the active state to the passive state when the ear hook (3) is turned about the first axis (A1) in the second direction (P2) from the active position to a second passive position.

13 Claims, 3 Drawing Sheets

HEADSET WITH TURNABLE EAR HOOK WITH TWO OFF POSITIONS

TECHNICAL FIELD

The invention relates to a headset comprising a housing with headset electronics and an ear hook for attaching the headset to a users ear, wherein the headset comprises a switch, an actuating member, which is turnable in relation to the housing about a first axis, the ear hook is attached to the actuating member, the ear hook can be arranged in a right ear mode for wearing the headset at the right ear and a left ear mode for wearing the headset at the left ear, and wherein the switch switches the headset electronics from an active state to a passive state, when the actuating member is turned about the first axis in a first direction from an active position to a first passive position and from the passive state to the active state, when turned in a second opposite direction from the first passive position to the active position.

BACKGROUND ART

Communication headsets are becoming more and more widely used. Especially, small Bluetooth headsets to be used with cellular phones have become increasingly popular the recent years.

A modern headset is a small compact unit with small operating buttons on the surface. In order to change mode of the headset, e.g. switching the headset on/off or answering a telephone call, the user typically presses a small momentary button. As the headset is a small unit, the button is often very small and it can be cumbersome to press it correctly. Thus, it is desirable to provide switching function of a headset without this disadvantage.

U.S. Pat. No. 7,046,799 discloses a headset with a pivotally mounted ear hook and an activation switch that activates the headset when the ear hook is in an open position and deactivates the headset when the ear hook is in a closed position.

WO 2008/145127 discloses a headset with a turnable speaker tower wherein the headset can be switched on and off by turning the speaker tower about an axis. According to an embodiment, an ear hook can be attached to the speaker tower. When the ear hook is arranged for right ear use, the ear hook is turned into a compact position, when the headset is switched off. This is very advantageous, as the headset takes up less space. Furthermore, the risk of unintended switching "on" is small, as it requires that the ear hook must be turned into an active and less compact position. However, when the ear hook is arranged for left ear use, the ear hook is not turned into a compact position when the headset is switched off. Thus, the ear hook points away from the headset housing, which is disadvantageous, if the user wants to keep the headset in his pocket or the like. Furthermore, the risk of unintended switching "on" can be higher when the ear hook is not kept in a compact position.

DISCLOSURE OF INVENTION

An object of the invention is to provide a headset with improved switching functionality for both left ear use and right ear use.

According to the invention the object is obtained by a headset according to the preamble which is characterized in that the switch switches the headset electronics from the active state to the passive state when the actuating member is turned about the first axis in the second direction from the active position to a second passive position and from the passive state to the active state when turned in the first direction from the second passive position to the active position. With such a headset, the headset electronics can be switched to a passive state by turning the ear hook into a passive and more compact position, irrespective of the ear hook being arranged in right ear mode or left ear mode.

According to an embodiment, the housing comprises an inner side facing the user's ear during use and an outer side facing away from the user's ear during use, wherein the headset further comprises a speaker tower extending from the inner side along the first axis.

The actuating member may be a turnable part of the speaker tower. This turnable part is preferably a distal part of the speaker tower. Such a construction is relatively easy to implement.

Preferably, the ear hook is detachably attached to the actuating member. This may be advantageous, as the user in certain cases may prefer to use the headset without the ear hook, e.g. by attaching the headset by inserting an earbud in the ear.

According to a preferred embodiment, the actuating member comprises a through going mounting hole to which the ear hook can be inserted from one end for right ear mode and the other end for left ear mode. This is a particularly simple way of implementing the possibility of changing the ear hook from right ear mode to left ear mode and vice versa.

According to an alternative embodiment, the ear hook comprises an ear engaging part and a headset engaging part, which are interconnected by an ear hook hinge, such that the ear engaging part can rotate about a third axis in relation to the headset engaging part. With such a solution it is not necessary to detach the ear hook in order to change from right ear mode to left ear mode and vice versa.

The first axis and the third axis can be essentially perpendicular.

According to an embodiment, the turning angle between the active position and any of the first and second passive positions is between 45 and 135 degrees, preferably between 60 and 120 degrees, more preferably between 75 and 115 degrees, even more preferably between 80 and 100 degrees, most preferably between 85 and 85 degrees, e.g. essentially 90 degrees. A turning angle of a certain size is preferred in order to obtain a movement from an active position to a passive, more compact position and in order to better distinguish active mode from passive mode by just looking at the headset.

Preferably, the headset comprises a detent mechanism for releasably holding the actuating member in the active position, the first passive position and the second passive position. In this way, a more reliable functioning is obtained.

According to particularly preferred embodiment, the headset electronics are in the passive state, when the actuating member is in the first and second passive positions and in active state, when the actuating member is in the active position and any intermediate position between the active position and the first and second passive positions. Hereby, the risk of unintended switching from active mode to passive mode, e.g. during a phone call, is minimized, as the ear hook must be turned completely to one of the passive positions in order to switch to passive mode.

According to a specific embodiment, the switch comprises a proximity sensor, which is fixed in relation to the housing and where the actuating member comprises a first sensor target, which is sensed by the proximity sensor, when the actuating member is in the first passive position, and a second sensor target, which is sensed by the proximity sensor, when the actuating member is in the second passive position. The proximity switch may be a Hall Effect switch.

BRIEF DESCRIPTION OF THE DRAWINGS

The invention is explained in detail below with reference to the drawing illustrating a preferred embodiment of the invention and in which.

MODES FOR CARRYING OUT THE INVENTION

Figure 1:
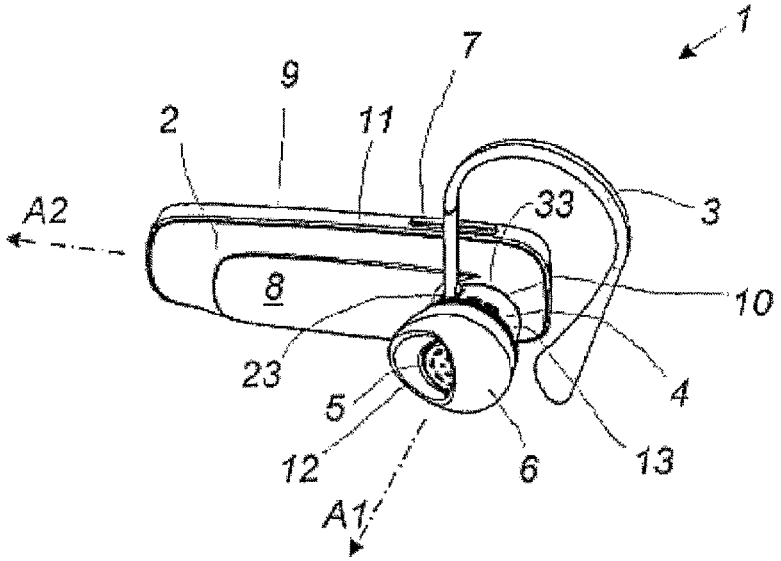
FIG. 1 is a perspective view of a first embodiment of a headset according to the invention.

FIG. 1 discloses a headset 1 according to a first embodiment of the invention. The headset 1 is a wireless headset following the Bluetooth standard and is inter alia intended for use with cell phones. The headset 1 comprises a headset housing 2, which encloses the major part of the headset electronics, such as printed circuit board, Bluetooth transceiver chip, battery, audio processing electronics etc. The housing 2 has a first housing side 8 facing the users head during use and a second opposite housing side 9 facing away from the users head during use. A peripheral wall 11 connects the first housing side 8 and the second housing side 9. A so-called speaker tower 4 projects from the first housing side 8 along a first axis A1 and comprises a speaker with a speaker front 5. The housing 2 extends along a second axis A2. The angle between the first axis A1 and the second axis A2 is approximately 80-90°. An ear bud 6 of soft material with a sound opening 12 is arranged on the distal end of the speaker tower 4 and is adapted for inserting into the lower concha of the users ear. An ear hook 3 is detachably inserted in a through going, transversal hole 23 in the speaker tower 4. A non-visible microphone is arranged at left-most end of the housing 2 in FIG. 1.

The speaker tower 4 is divided by a narrow slot 10 into a fixed part 33 and a turnable part 13. The turnable part 13 is turnable about the first axis A1.

Figure 2:
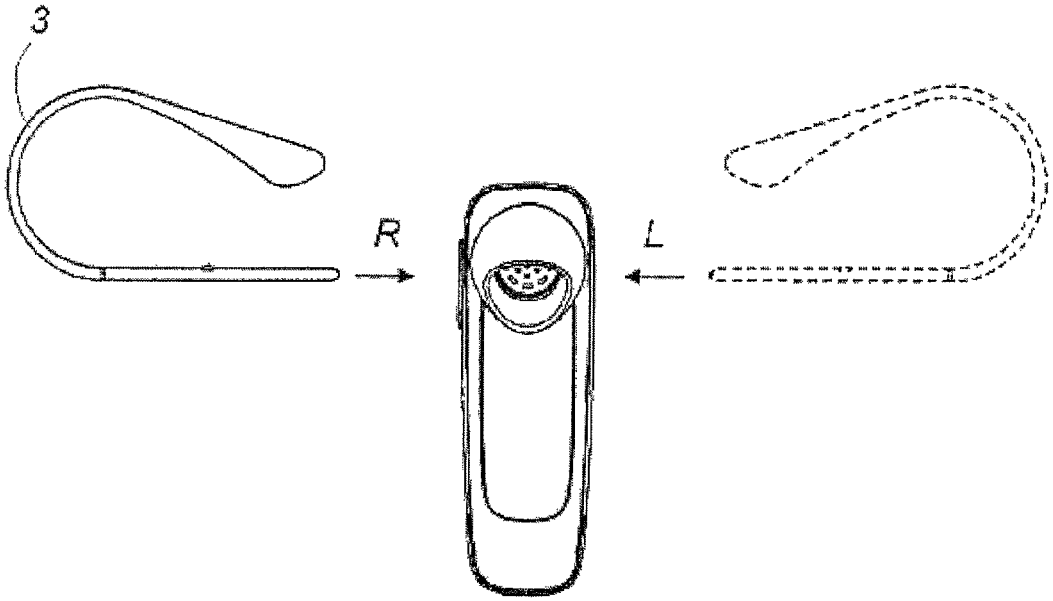
FIG. 2 is a bottom view of the headset according to the first embodiment with indications of how to arrange the ear hook for right ear use and left ear use, respectively.

FIG. 2 illustrates how the ear hook 3 can be arranged for right ear use and let ear use. The full line illustration of the ear hook 3 and arrow R show in which direction the ear hook 3 must be inserted into the transversal hole 23 in the speaker tower 4, when the user wants the wear the headset 1 on the right ear. The phantom lines in FIG. 2 and the arrow L illustrate how to insert the ear hook when the headset 1 is to be worn on the left ear.

The turnable part 13 of the speaker tower 4 can be rotated into three fixed positions, namely one active position and two passive positions.

Figure 3:
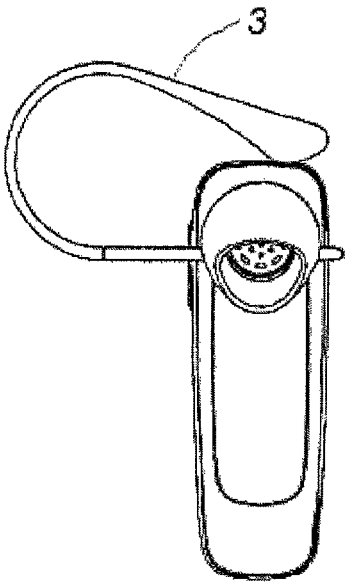
FIG. 3 is a bottom view of the headset according to the first embodiment where the ear hook is arranged for right ear use and in an active position.

In FIG. 3, the ear hook 3 is arranged for right ear use, and the turnable part 13 of the speaker tower 4 and the ear hook 3 is turned into the active position, where the headset 1 is switched on.

Figure 4:
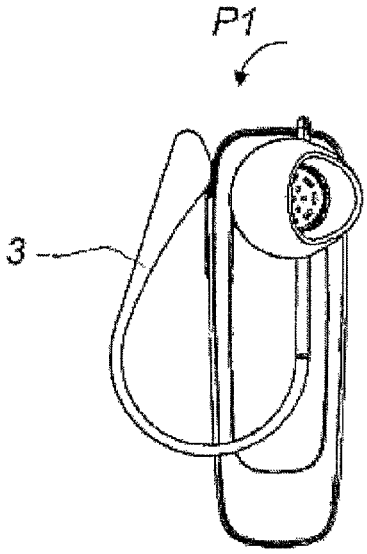
FIG. 4 is a bottom view of the headset according to the first embodiment where the ear hook is arranged for right ear use and in the passive position.

In FIG. 4, the turnable part 13 and the ear hook 3 is turned approximately 90 degrees in the direction of the arrow P1 to the first passive position, where the headset 1 is switched off.

Figure 5:
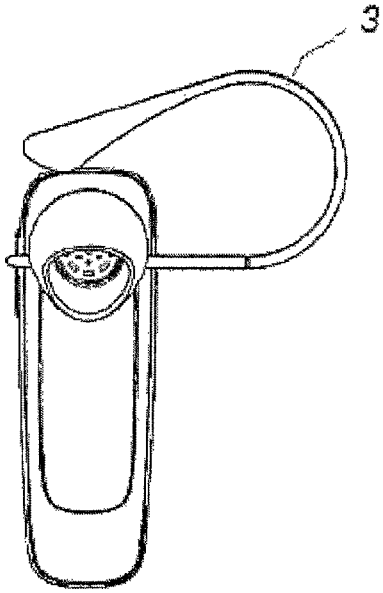
FIG. 5 is a bottom view of the headset according to the first embodiment seen where the ear hook is arranged for left ear use and in the active position.

In FIG. 5, the ear hook 3 is arranged for left ear use, and the turnable part 13 of the speaker tower 4 and the ear hook 3 is turned into the active position, where the headset 1 is switched on.

Figure 6:
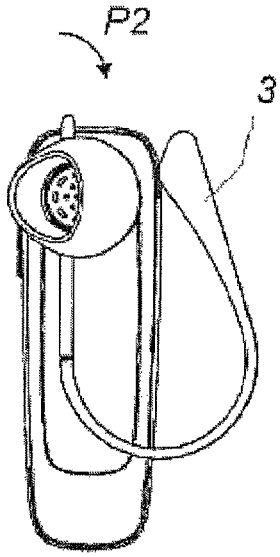
FIG. 6 is a bottom view of the headset according to the first embodiment where the ear hook is arranged for left ear use and in the passive position.

In FIG. 6, the turnable part 13 and the ear hook 3 is turned approximately 90 degrees in the direction of the arrow P2 to the second passive position, where the headset 1 is switched off.

Figure 7:
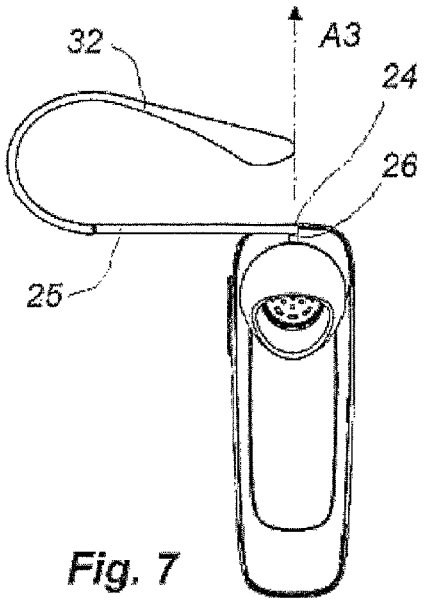
FIG. 7 is a bottom view of a headset according to a second embodiment where the ear hook is arranged for right ear use and in the active position.
Figure 8:
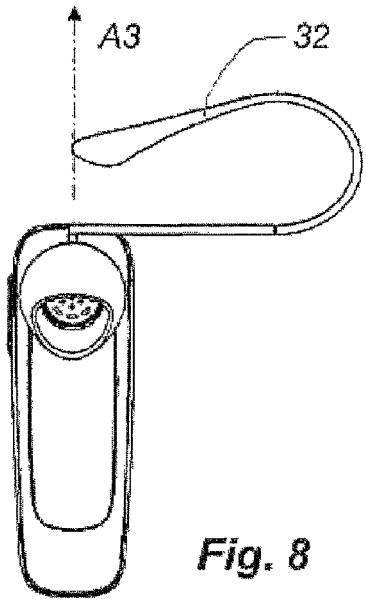
FIG. 8 is a bottom view of the headset according to the second embodiment where the ear hook is arranged for left ear use and in the active position.

FIGS. 7 and 8 disclose a second embodiment of headset according to the invention. In this embodiment, the ear hook 32 is divided into an ear engaging part 25 and a headset engaging part 26. These two parts are interconnected be an ear hook hinge 24, such that the ear engaging part 25 is turnable approximately 180 degrees about a third axis A3 in order to change the ear hook between right ear use and left ear use. FIG. 7 shows the headset 1 with the ear hook 32 arranged for right ear use, and FIG. 8 shows the headset 1 with the ear hook 32 arranged for left ear use.

Figure 9:
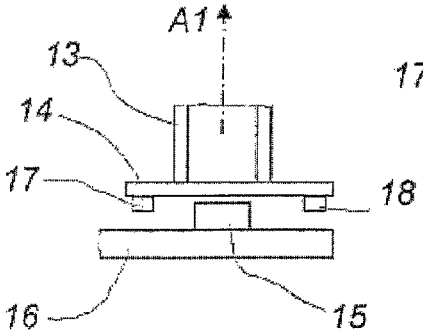
FIG. 9 is a schematic side view of a first embodiment of the headset comprising the switching mechanism in the active position.

FIG. 9 is a schematic side view of a portion of the headset comprising the switching mechanism. Only the most necessary parts are shown in order to explain how the switch mechanism works. The turnable part 13 of the speaker tower is at the bottom connected to a disc 14, which turns with the turnable part 13. A first magnet 17 and a second magnet 18 is attached to the under side of the turnable click 14. A printed circuit board 16 comprises a Hall Effect switch 15, which is placed close to the turnable disc 14. FIG. 9 shows the active position of the ear hook 3; 32.

Figure 10:
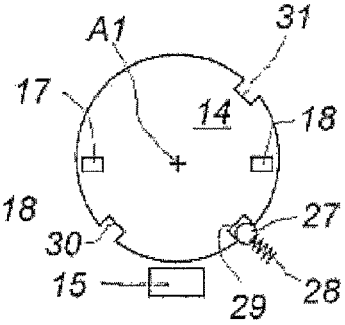
FIG. 10 is a schematic top view of the same switching mechanism in the active position.
Figure 11:
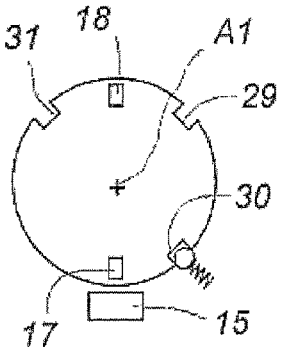
FIG. 11 is a schematic top view of the same switching mechanism in one of the passive positions.

FIGS. 10 and 11 are schematic top views of the turnable disc 14, the first and second magnets 17, 18 and the Hall Effect switch 15. When the ear hook 3; 32 is in the active position, as shown in FIG. 10, the first and the second magnets 17, 18 are spaced apart from the Hall Effect switch 15. When the ear hook 3; 32, the turnable part 13 and the turnable disc 14 is turned into the first passive position, the first magnet 17 is turned in to close proximity of the Hall Effect switch 15, which switches the headset electronics off. This is shown in FIG. 11. Likewise, if the hook 3; 32, the turnable part 13 and the turnable disc 14 is turned into the second passive position, the second magnet 18 is turned in to close proximity of the Hall Effect switch 15, which also switches the headset electronics off.

A ball 29, a spring 28 and three recesses 29, 30 and 31 provides a detent mechanism for releasably holding the ear hook 3, 32 in the active position, the first passive position and the second passive position. Thus, the spring-biased ball 27 engages the first recess 29 for holding the ear hook 3, 32 in the active position, while the ball 27 engages the second recess 30, when the ear hook 3; 32 is in the first passive position and the third recess 31 when the ear hook 3; 32 is in the second passive position. A certain turning force is needed to turn the ear hook 3; 32 out of these three positions.

Figure 12:
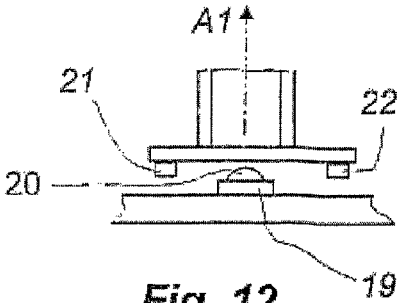
FIG. 12 is a schematic side view of an alternative embodiment of the switching mechanism in the active position.
Figure 13:
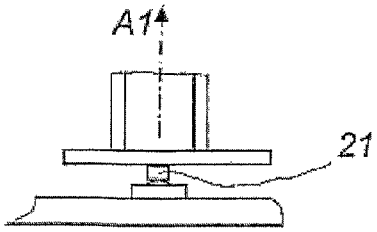
FIG. 13 is a schematic side view of the switching mechanism shown in FIG. 12 in one of the passive positions.

FIGS. 12 and 13 disclose an alternative embodiment of the switching mechanism. Here, the Hall Effect switch 15 is replaced by a micro switch 19 with a mechanical actuator 20, and the first and second magnets 17, 18 are replaced by first and second protrusions 21, 22. When the ear hook 3; 32, the turnable part 13 and the turnable disc 14 is turned into the first passive position, the first protrusion 21 presses the switch actuator 20 of the micro switch 19 down, which switches the headset electronics off. This is shown in FIG. 12. Likewise, when the ear hook 3; 32, the turnable part 13 and the turnable disc 14 is turned into the second passive position, the second protrusion 22 presses the switch actuator 20 of the micro switch 19 down, which switches the headset electronics off. This is shown in FIG. 13.

In the embodiments shown in FIGS. 9-13, the headset is switched on, until the ear hook 3; 32, the turnable part 13 of the speaker tower 4 and the disc 14 reaches the first or the second passive positions. Thus, the headset 1 is not accidently switched off if the user unintended moves the ear hook 3; 32 out of the active position. In fact, the user must turn the ear hook 3; 32 approximately 90 degrees in either direction away from the active position to switch the headset off.

In the disclosed embodiments, the ear hook 3; 32 is used to switch the headset on and off. The "off" condition can be a condition where the headset uses no power at all, or I could be a sleep or standby mode, where only a little power is consumed.

The turning movement of the ear hook 2, 32 could also be used for answering and end phone calls. Thus, If the ear hook 2, 32 is in one of the passive positions and the phone rings, the user can answer the call by turning the ear hook 3; 32 to the active position and end the call by turning the ear hook 3; 32 to the passive position. It is also possible to combine the switching on/off function with the accept/end call function. Thus, if the headset 1 is switched off while the phone rings, the user can switch the headset 1 on and, simultaneously, accept the call by turning the ear hook 2, 32 from the passive to the active position.

Different materials can be used for the headset 1. Preferably, plastics are used to manufacture the housing 2. The ear hook 2, 32 can be made of plastics or metal, e.g. spring steel and it can be manufactured from more than on material, such as rubber-coated metal. The ear gel 6 is preferably made from rubber, silicone or other soft material.

The headset according to the invention is not necessarily a wireless headset. It could also be corded.

The speaker can be arranged in the turnable 13 part of the speaker tower 4 or in the housing 2.

The turnable actuating member does not necessarily have to be a part 13 of the speaker tower 4. It could be part which is turnable attached to the housing 2 at another area, e.g. beside the speaker tower 4.

Turning angles may be different for left and right ear mode due asymmetric position of axis of the turnable part.

Other switches than those disclosed here may be used. The switch could also be arranged in the turnable part.

| Reference signs used in the figures and the detailed description: | |
|---|---|
| 1 | headset |
| 2 | headset housing |
| 3 | ear hook |
| 4 | speaker tower |
| 5 | speaker front |
| 6 | ear bud |
| 7 | multi function button |
| 8 | inner side of headset housing |
| 9 | outer side of headset housing |
| 10 | slot between speaker tower and housing |
| 11 | peripheral wall of housing |
| 12 | sound opening |
| 13 | turnable part of speaker tower |
| 14 | turnable disc |
| 15 | Hall Effect switch |
| 16 | printed circuit board |
| 17 | first magnet |
| 18 | second magnet |
| 19 | push button switch |
| 20 | actuator |
| 21 | first protrusion |
| 22 | second protrusion |
| 23 | mounting hole |
| 24 | ear hook hinge |
| 25 | ear engaging part of ear hook |
| 26 | headset engaging part of ear hook |
| 27 | ball |
| 28 | spring |
| 29, 30, 31 | recesses |
| 32 | ear hook |
| 33 | fixed part of speaker tower |
| A1 | first axis |
| A2 | second axis |
| A3 | third axis |
| P1 | first direction |
| P2 | second direction |
| R | insertion direction |
| L | insertion direction |

The invention claimed is:

1. A headset comprising a housing with headset electronics and an ear hook for attaching the headset to a users ear, and for switching the headset from an active, power on state, to a passive, standby or power off state, wherein the headset comprises a switch, an actuating member, which is turnable in relation to the housing about a first axis, the ear hook is attached to the actuating member, the ear hook can be arranged in a right ear mode for wearing the headset at the right ear and a left ear mode for wearing the headset at the left ear, wherein the passive state has the ear hook and the housing are substantially overlapping in a compact storage position, and the active state has the ear hook rotated generally orthogonal to the housing, in a user wearable position, the switch switches the headset electronics from an active state to a passive state, when the actuating member is turned about the first axis in a first direction from an active position to a first passive position and from the passive state to the active state, when turned in a second opposite direction from the first passive position to the active position, wherein the switch switches the headset electronics from the active state to the passive state when the actuating member is turned about the first axis in the second direction from the active position to a second passive position and from the second passive state to the active state when turned in the first direction from the second passive position to the active position, wherein the housing comprises an inner side facing the user's ear during use and an outer side facing away from the user's ear during use, and the headset further comprises a speaker tower extending from the inner side along the first axis, and wherein the actuating member constitutes a turnable part of the speaker tower.

2. A headset according to claim 1, wherein the turnable part of the speaker tower is a distal part of the speaker tower.

3. A headset according to claim 1, wherein the ear hook is detachably attached to the actuating member.

4. A headset according to claim 3, wherein the actuating member comprises a through going mounting hole to which the ear hook can be inserted from one end for right ear mode and the other end for left ear mode.

5. A headset according to claim 1, wherein the ear hook comprises an ear engaging part and a headset engaging part, which are interconnected by an ear hook hinge, such that the ear engaging part can rotate about a third axis in relation to the headset engaging part.

6. A headset according to claim 5, wherein the first axis and the third axis are essentially perpendicular.

7. A headset according to claim 1, wherein the turning angle between the active position and any of the first and second passive positions is between 45 and 135 degrees.

8. A headset according to claim 1, wherein the headset comprises a detent mechanism for releasably holding the actuating member in the active position, the first passive position and the second passive position.

9. A headset according to claim 8, wherein the headset electronics are in the passive state, when the actuating member is in the first and second passive positions and in active state, when the actuating member is in the active position and any intermediate position between the active position and the first and second passive positions.

10. A headset according to claim 1 wherein the switch comprises a proximity sensor, which is fixed in relation to the housing and where the actuating member comprises a first sensor target, which is sensed by the proximity sensor, when the actuating member is in the first passive position, and a second sensor target, which is sensed by the proximity sensor, when the actuating member is in the second passive position.

11. A headset according to claim 10, wherein the proximity switch is a Hall Effect switch.

12. A headset comprising a housing with headset electronics, a rotatable speaker tower, and an ear hook attached to the speaker tower for attaching the headset to a users ear, and for rotatably switching the headset from an active, power on state, to a passive, standby or power off state wherein the headset comprises a rotatable switch, having a disk with position detents located to correspond to power on and off states of rotation;

an actuating member, which is turnable in relation to the housing about a first axis, the ear hook is attached to the actuating member, the ear hook can be arranged in a right ear mode for wearing the headset at the right ear and a left ear mode for wearing the headset at the left ear, wherein the passive state has the ear hook and the housing are substantially overlapping in a compact storage position, and the active state has the ear hook rotated generally orthogonal to the housing, in a user wearable position, the switch switches the headset electronics from an active state to a passive state, when the actuating member is turned about the first axis in a first direction from an active position to a first passive position and from the passive state to the active state, when turned in a second opposite direction from the first passive position to the active position, wherein the switch switches the headset electronics from the active state to the passive state when the actuating member is turned about the first axis in the second direction from the active position to a second passive position and from the second passive state to the active state when turned in the first direction from the second passive position to the active position, wherein the housing comprises an inner side facing the user's ear during use and an outer side facing away from the user's ear during use, and wherein the speaker tower extends from the inner side along the first axis, and wherein the actuating member constitutes a turnable part of the speaker tower.

13. A headset comprising a housing with headset electronics, a rotatable speaker tower, and an ear hook attached to the speaker tower for attaching the headset to a users ear, and for rotatably switching the headset from an active, power on state, and two a passive, standby or power off states which are 90 degrees off the active position wherein the headset comprises a rotatable switch, having a disk with position detents located to correspond to power on and off states of rotation;

an actuating member, which is turnable in relation to the housing about a first axis, the ear hook is attached to the actuating member, the ear hook can be arranged in a right ear mode for wearing the headset at the right ear and a left ear mode for wearing the headset at the left ear, wherein the passive state has the ear hook and the housing are substantially overlapping in a compact storage position, and the active state has the ear hook rotated generally orthogonal to the housing, in a user wearable position, the switch switches the headset electronics from an active state to a passive state, when the actuating member is turned about the first axis in a first direction from an active position to a first passive position and from the passive state to the active state, when turned in a second opposite direction from the first passive position to the active position, wherein the switch switches the headset electronics from the active state to the passive state when the actuating member is turned about the first axis in the second direction from the active position to a second passive position and from the second passive state to the active state when turned in the first direction from the second passive position to the active position, wherein the housing comprises an inner side facing the user's ear during use and an outer side facing away from the user's ear during use, and wherein the speaker tower extends from the inner side along the first axis, and wherein the actuating member constitutes a turnable part of the speaker tower.

* * * * *